US009194655B1

(12) United States Patent
Cha

(10) Patent No.: US 9,194,655 B1
(45) Date of Patent: Nov. 24, 2015

(54) ADJUSTABLE GUN HOLSTER

(71) Applicant: Chou Cha, Northglenn, CO (US)

(72) Inventor: Chou Cha, Northglenn, CO (US)

( * ) Notice: Subject to any disclaimer, the term of this patent is extended or adjusted under 35 U.S.C. 154(b) by 0 days.

(21) Appl. No.: 14/323,488

(22) Filed: Jul. 3, 2014

(51) Int. Cl.
*F41C 33/00* (2006.01)
*A45F 3/14* (2006.01)
*A45F 3/00* (2006.01)

(52) U.S. Cl.
CPC ..... *F41C 33/005* (2013.01); *A45F 3/14* (2013.01); *A45F 2003/001* (2013.01)

(58) Field of Classification Search
CPC ... Y10S 224/913; F41C 33/005; F41C 33/003
USPC ..... 224/149, 913, 250, 150, 192, 193, 647, 224/648, 649, 663, 671, 674, 675
See application file for complete search history.

(56) References Cited

U.S. PATENT DOCUMENTS

| | | | | |
|---|---|---|---|---|
| 2,884,172 | A * | 4/1959 | Kubo | 224/149 |
| 4,964,553 | A * | 10/1990 | Glynn | F41C 33/003 224/149 |
| 5,325,618 | A * | 7/1994 | Turner | 42/85 |
| 5,664,721 | A | 9/1997 | Homeyer | |
| 6,119,907 | A | 9/2000 | Benjamin | |
| 6,152,338 | A | 11/2000 | Smith | |
| 6,311,885 | B1 | 11/2001 | Miller | |
| 6,363,532 | B1 | 4/2002 | Miller | |
| 6,431,424 | B1 | 8/2002 | Smith | |
| 2007/0023467 | A1 * | 2/2007 | Spreer | 224/149 |
| 2007/0145091 | A1 * | 6/2007 | Meesey | 224/649 |
| 2010/0012691 | A1 | 1/2010 | Hyle | |
| 2011/0042427 | A1 * | 2/2011 | Goransson-Sonnefelt | 224/149 |
| 2011/0290844 | A1 | 12/2011 | Hoffman | |
| 2012/0043358 | A1 | 2/2012 | Kelly | |
| 2012/0292353 | A1 * | 11/2012 | Andersen | 224/149 |
| 2013/0284784 | A1 | 10/2013 | Jakal | |
| 2014/0151413 | A1 * | 6/2014 | Ponder | 224/149 |

FOREIGN PATENT DOCUMENTS

| | | |
|---|---|---|
| WO | WO9314669 | 8/1993 |

* cited by examiner

*Primary Examiner* — J. Gregory Pickett
*Assistant Examiner* — Corey Skurdal
(74) *Attorney, Agent, or Firm* — Leyendecker & Lemire, LLC

(57) ABSTRACT

An adjustable gun holster is described. Embodiments of the holster include a first member for receiving a buttstock of a gun and a second member for receiving a forestock/barrel of the gun. The holster can further include a pair of attachment structures to removably couple to a shoulder strap of a pack. The holster can be adjusted to fit guns having differing lengths. For instance, the holster can be adapted for a short barreled shotgun and a long barreled rifle. To holster varying sized guns, a strap connecting the first member to the second member can be lengthened and shortened.

20 Claims, 7 Drawing Sheets

ADJUSTABLE GUN HOLSTER

BACKGROUND

While hunting, there is often a need to carry a rifle for a long distance and/or for long periods of time before a hunter encounters game. To preserve energy, many different holsters have been adapted to carry long guns. Generally, the holsters are integrated into and part of a pack. As such, a hunter usually must buy a pack designed for a specific type or length of gun.

Currently, there are several different devices and packs adapted for carrying elongated objects such as long-barreled weapons. Most packs are specifically designed to include an attachment means for securing a long barreled weapon to the pack. As such, a user must buy a pack adapted to secure a long barreled weapon. Since most hunters hunt various game, a different pack for each type of weapon is usually needed. For example, a hunter may have a pack for deer season adapted to fit a rifle while also having a pack adapted to carry a shotgun for duck season.

A universal holster for long barreled weapons that can be attached to a variety of different types of packs is needed.

DETAILED DESCRIPTION

Figure 1:
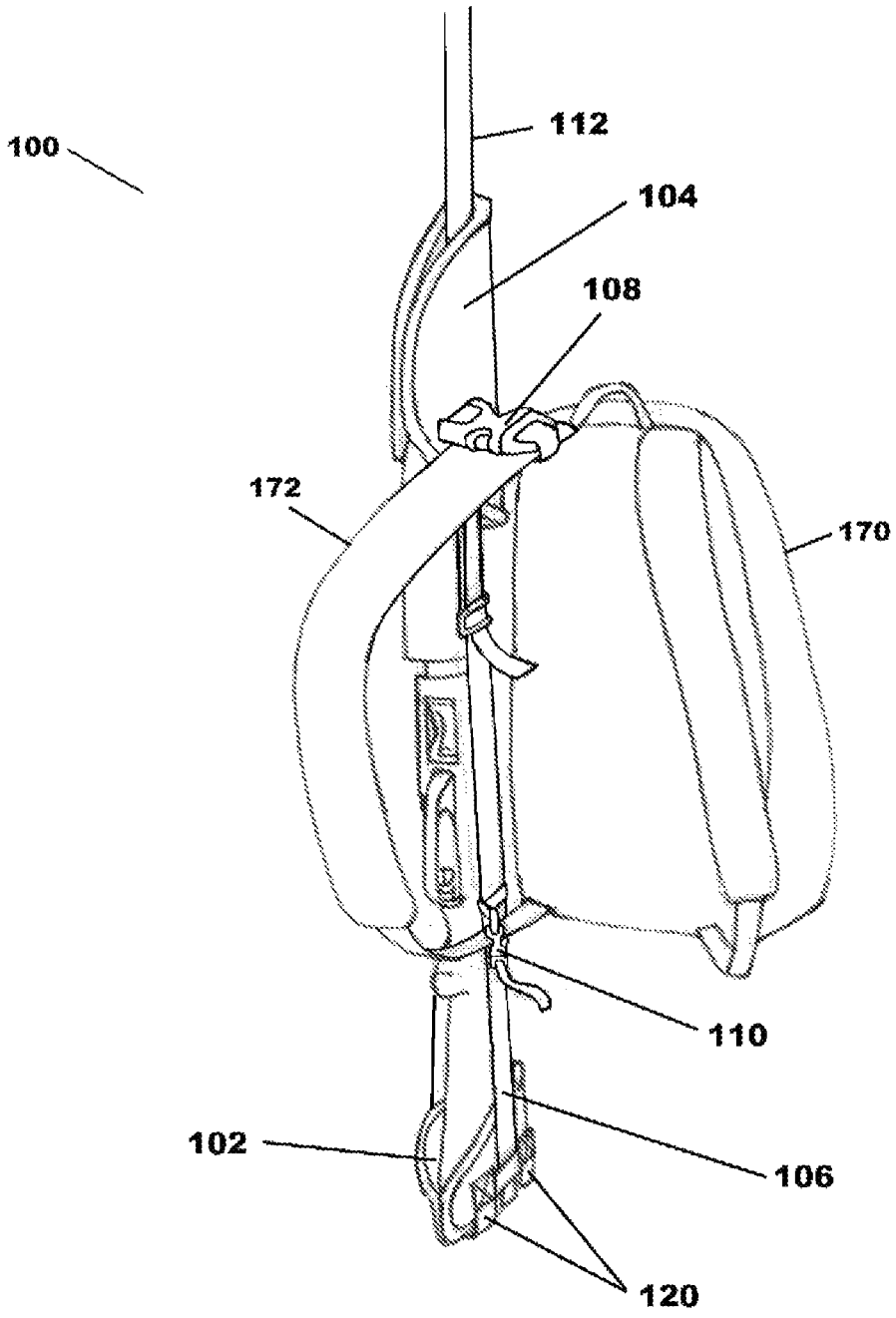
FIG. 1 is a perspective view of an adjustable holster attached to a pack according to one embodiment of the present invention.

Embodiments of the present invention include a long gun holster adapted to be removably attached to a pack. Generally, the holster can include a first member and a second member. The first member can interface with a buttstock of a gun and the second member can interface with a forestock/barrel of the gun. A connector strap can be implemented to couple the first member to the second member. Generally, a length of the connector strap can be adjusted to fit varying sized guns into the holster.

Typically, the holster can be coupled to a pack having at least one shoulder strap. To couple the holster to the pack, the holster can include a first attachment structure and a second attachment structure. For instance, the first attachment structure can couple to an upper portion of a backpack strap and the second attachment structure can attach to a lower portion of the backpack strap. In one embodiment, the first attachment structure can be directly coupled to the second member. The second attachment structure can typically be slidably coupled to the connector strap. In one embodiment, the attachment structures can be loops having quick release buckles to attach and detach from a shoulder strap.

In one exemplary implementation of the holster, a user can first secure a gun to the holster. Generally, the user can insert the buttstock into the first member and the forestock/barrel into the second member. After the gun is inserted into the two members, the connector strap can be tightened to further secure the gun. After the gun is secure in the holster, the user can attach the holster to a pack. To attach the holster, the user can detach each of the quick release buckles of the attachment structures and secure them around an upper portion and a lower portion of a shoulder strap of a pack.

TERMINOLOGY

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase’s case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term “directly coupled” or “coupled directly,” as used in this specification and appended claims, refers to a physical connection between identified elements, components, or objects, in which no other element, component, or object resides between those identified as being directly coupled.

The term “approximately,” as used in this specification and appended claims, refers to plus or minus 10% of the value given.

The term “about,” as used in this specification and appended claims, refers to plus or minus 20% of the value given.

The terms “generally” and “substantially,” as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

The terms “long gun” and “gun,” as used in this specification and appended claims, refers to a small arms long gun including, but not limited to, a rifle, a shotgun, a musket, a blunderbuss, a carbine, a wall gun, and a musketoon.

The term “backpack,” “rucksack,” “knapsack,” and “pack,” as used in this specification and appended claims, refers to a sack secured to a user’s back by at least one strap that go over a shoulder(s) of the user.

An Embodiment of a Long Gun Holster

Referring to FIG. 1, a detailed diagram of an embodiment 100 showing a long gun holster is illustrated. The holster 100 can generally be implemented to secure a long gun to a pack. For instance, the holster 100 can be adapted to attach to a shoulder strap of a pack.

As shown in FIG. 1, the holster 100 can include a first member 102, a second member 104, a strap 106, a first attachment structure 108, and a second attachment structure 110.

The first member 102 can be implemented to receive a buttstock of a gun 112. Generally, the buttsock of the gun 112 can be inserted into the first member 102. In one embodiment, the first member 102 can be adapted to receive buttstocks having varying widths. For instance, a small caliber rifle with a narrow buttsock and a large caliber rifle having a wide buttstock can both be implemented with the first member 102.

Generally, the first member 102 can be made from materials being lightweight and having high tear resistance. For instance, the first member 102 can be made from materials including, but not limited to, woven materials, nonwoven materials, synthetic materials, and non-synthetic materials. Some examples of such materials include Kevlar, felt, carbon fiber, high density polyethylene, polyester, polypropylene, nylon, and other polymers.

Figure 2:
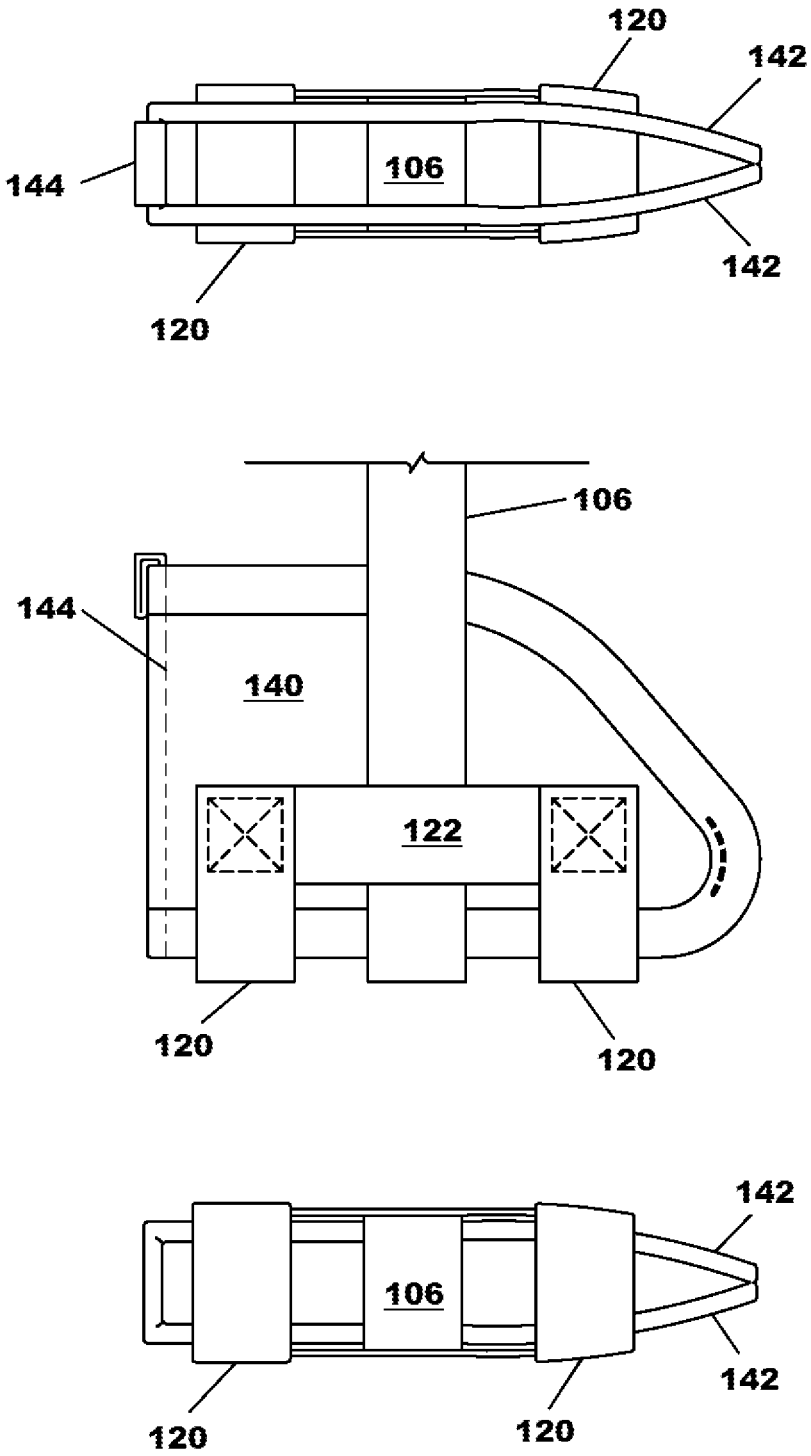
FIG. 2 includes a side, top, and bottom view of a first member according to one embodiment of the present invention.

Referring to FIG. 2, several detailed diagrams of the first member 102 are illustrated. In one embodiment, the first member 102 can be a panel 140 of material folded in half and coupled together at ends 142 of the panel 140. For instance, the ends 142 can be sewn together, as shown in the side view of FIG. 2. It is to be appreciated that the ends 142 of the panel 140 can be detachably coupled to each other. For example, magnets can be attached to the ends 142 of the panel 140 and adapted to couple to each other when brought together. The detachable coupling can include, but is not limited to, magnets, hook and loop patches, snap fasteners, buttons, and zippers.

The panel 140 can generally include a piece of closed cell foam encased in fabric. It is to be appreciated that other types of resilient materials can be implemented in place of the closed cell foam. The fabric can be selected from a variety of materials that are tear resistant and tough. In some embodiments, a waterproof fabric can be implemented.

Typically, a semi-rigid or rigid strip of material 144 can be included in the first member 102. The strip of material 144 can be implemented to provide support to the first member 102, as shown generally in FIG. 2. Generally, the strip of material 144 can include, but is not limited to, a strip of nylon, a strip of plastic, or a strip of metal.

Figure 3:
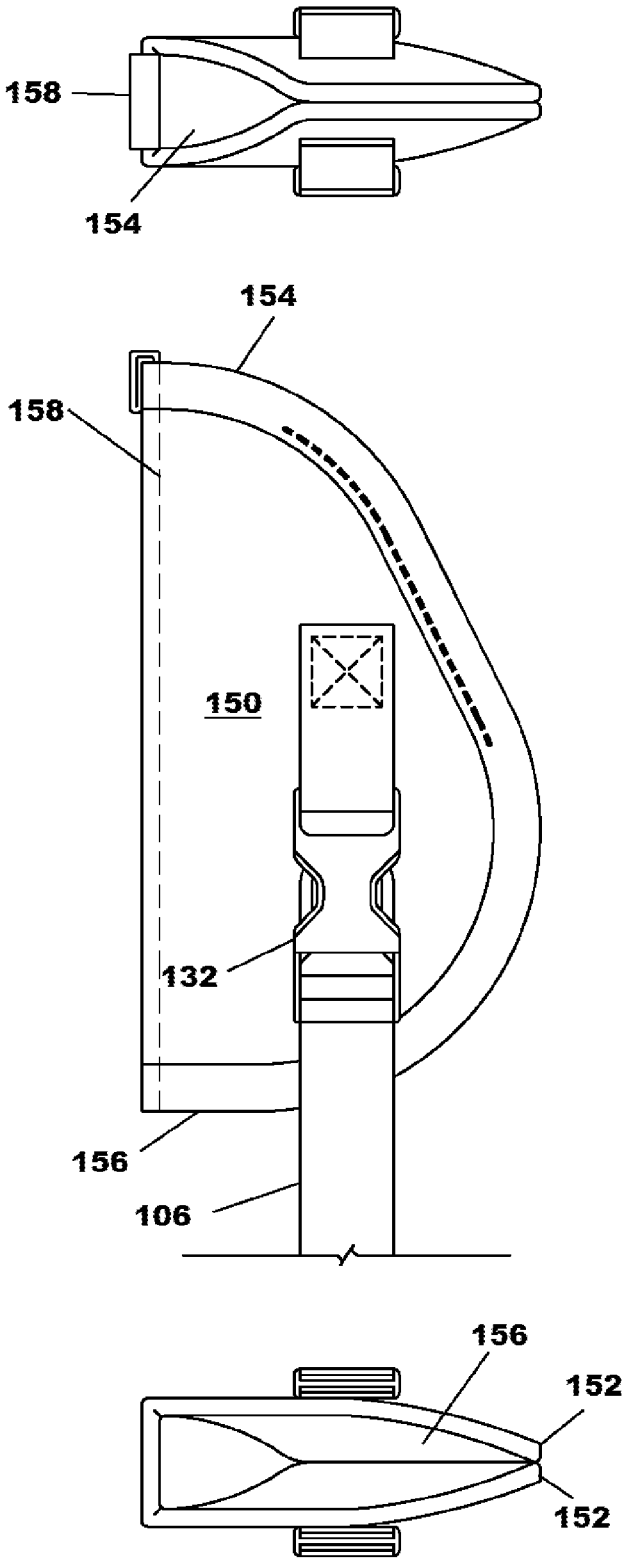
FIG. 3 includes a side, top, and bottom view of a second member according to one embodiment of the present invention.

Referring to FIG. 3, several detailed diagrams of the second member 104 are illustrated. The second member 104 can be implemented to receive a forestock and a barrel of the gun 112. Generally, the second member 104 can include a panel 150 of material folded in half forming a U-shaped member. In one embodiment, ends 152 of the panel 150 can be coupled together. Generally, only a portion of the ends 152 are coupled together forming a first opening 154 and a second opening 156. As shown, the barrel of the gun 112 can fit through the first opening 154 and the second opening 156 of the second member 104. The forestock of the gun 112 can fit through the first opening 154 but will generally not fit through the second opening 156. In another embodiment, the ends 152 of the panel 150 can be detachably coupled together. For example, magnets, hook and loop patches, snap fasteners, buttons, and zippers can be implemented to detachably couple the ends 152 together.

Figure 6:
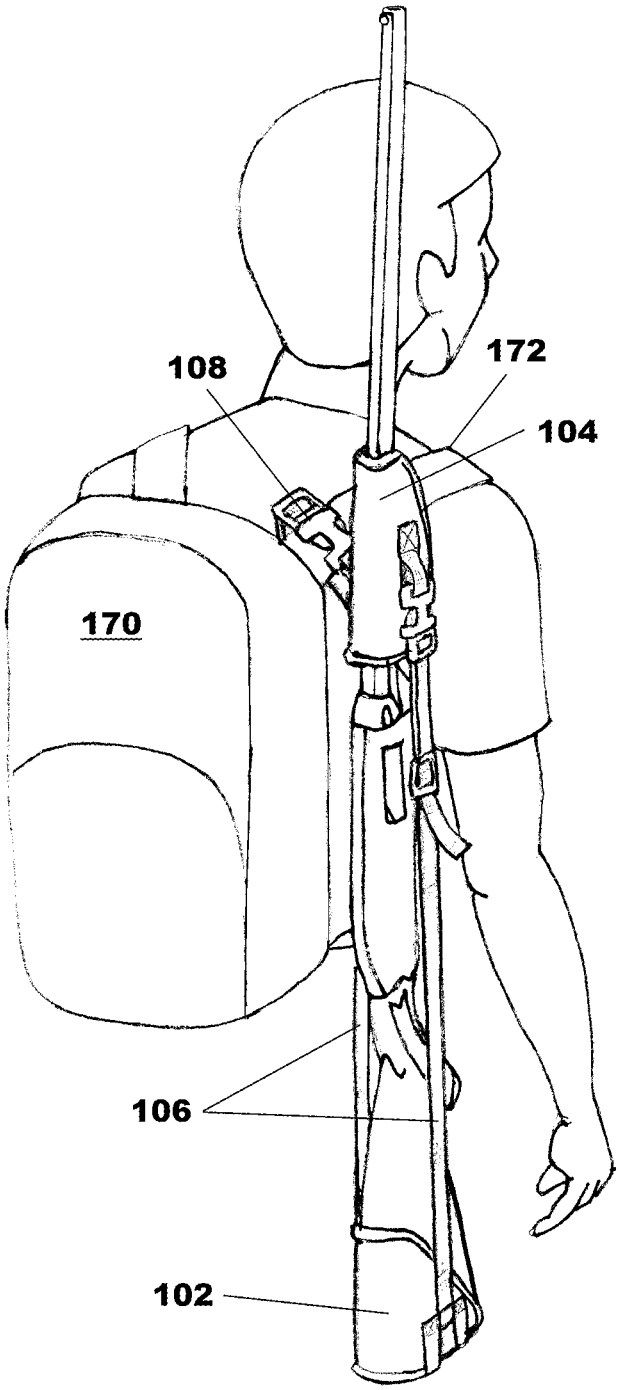
FIG. 6 is a perspective view of an adjustable holster attached to a pack according to one embodiment of the present invention.

As shown in FIG. 3, when the panel 150 is folded and coupled together, the second member 104 can be tapered. The tapering of the second member 104 allows the forestock and the barrel of the gun 112 to be snuggly engaged. As shown in FIGS. 1 and 6, the gun 112 can be inserted barrel first into the second member 104. As stated previously, generally only the barrel of the gun 112 can fit through the second opening 156 of the second member 104.

The panel 150 can generally include a piece of closed cell foam encased in fabric. It is to be appreciated that other types of resilient materials can be implemented in place of the closed cell foam. The fabric can be selected from a variety of materials that are tear resistant and tough. In some embodiments, a waterproof fabric can be implemented.

Similar to the first member 102, the second member 104 can include a semi-rigid or rigid strip of material 154 to provide support to the second member 104. The strip of material 154 can be implemented to provide support to the folded portion of the second member 104, as shown generally in FIG. 3. Generally, the strip of material 154 can include, but is not limited to, a strip of nylon, a strip of plastic, or a strip of metal.

As shown generally in the figures, the first member 102 can include a first pair of straps 120 and a second pair of straps 122. In one embodiment, the first pair of straps 120 can be implemented to provide support for a bottom portion of the first member 102. For instance, the first pair of straps 120 can be implemented as an interface to a bottom of the buttstock of the gun 112. The first pair of straps 120 can be implemented to stop the buttstock from sliding through the first member 102. Generally, the bottom of the buttstock can rest on the first pair of straps 120.

The second pair of straps 122 can be implemented as guide straps. For instance, the connector strap 106 can be guided through the pair of guide straps 122 to adjustably couple the first member 102 to the second member 104. Typically, the guide straps 122 can be coupled to opposite sides of the first member 102 and between the first pair of straps 120. It is to be appreciated that the guide straps 122 can be located in different positions on the first member 102 without exceeding a scope of the present invention.

To secure the first pair of straps 120 to the first member 102, one or more types of stitching can be implemented. In one embodiment, a box stitching can be included to attach the first pair of straps 120 to the first member 102. Generally, ends of the first pair of straps 120 can be attached to the first member 102 by box stitching. It is to be appreciated that box stitches can provide support for areas subject to stress. Depending on an implementation, the first pair of straps 120 can be attached to the first member 102 by different stitches at ends of the first pair of straps 120.

Figure 4:
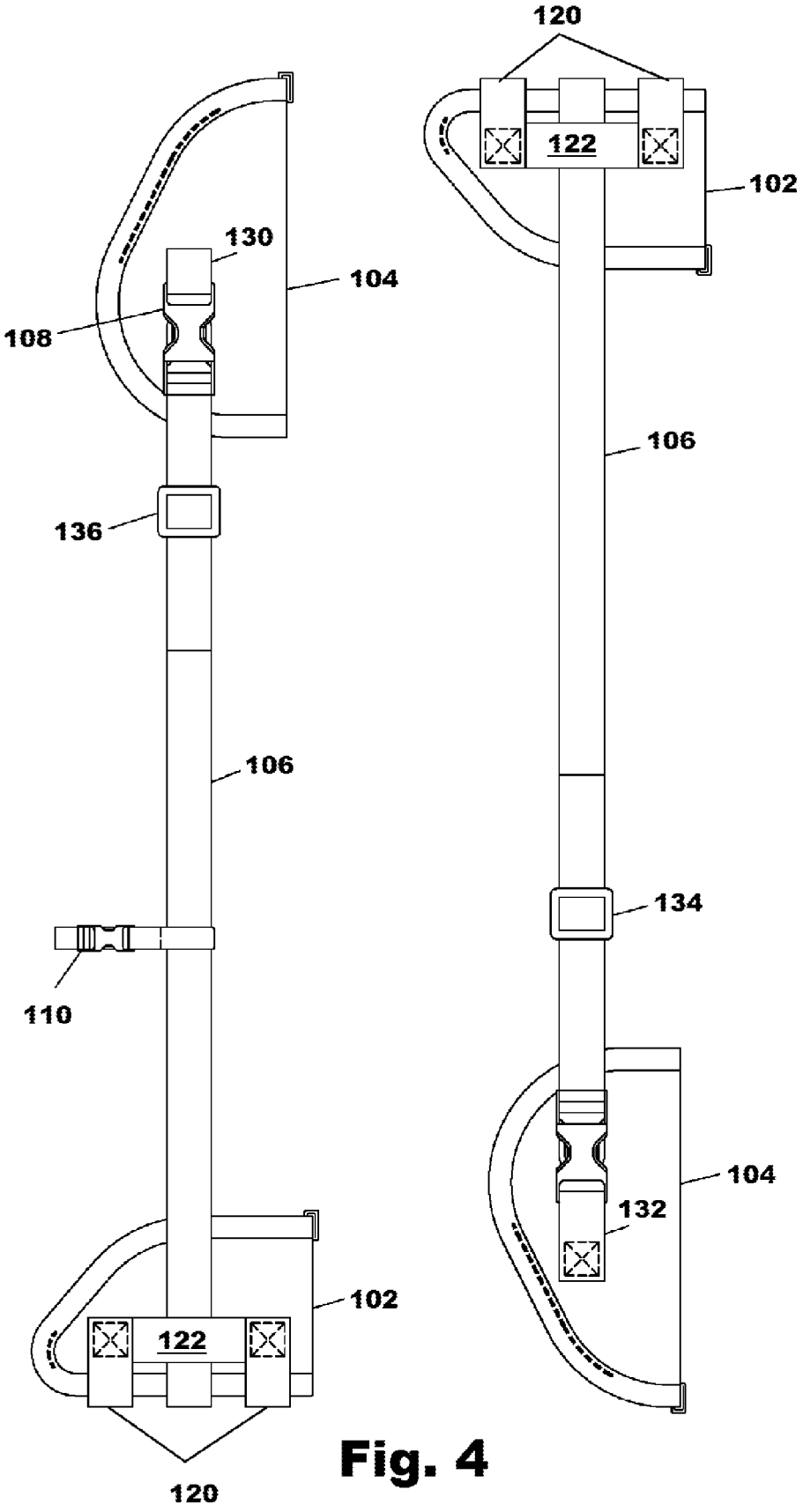
FIG. 4 includes side views of an adjustable holster according to one embodiment of the present invention.

Referring to FIG. 4, detailed diagrams showing side views of the holster 100 are illustrated. As shown in FIG. 4, the connector strap 106 can be implemented to adjustably couple the first member 102 to the second member 104. Generally, ends of the connector strap 106 can be coupled to opposite sides of the second member 104, as shown in FIG. 4. A first end 130 of the connector strap 106 can be coupled to one side of the second member 104. In one embodiment, the first end 130 can be directly coupled to the second member 104. For instance, a section of the first end 130 can be stitched to the second member 104. A second end 132 of the connector strap 106 can be detachably coupled to the other side of the second member 104. For instance, a quick connect can be implemented to detachably couple the second end 132 to the second member 104, as shown in FIG. 4.

Figure 5A:
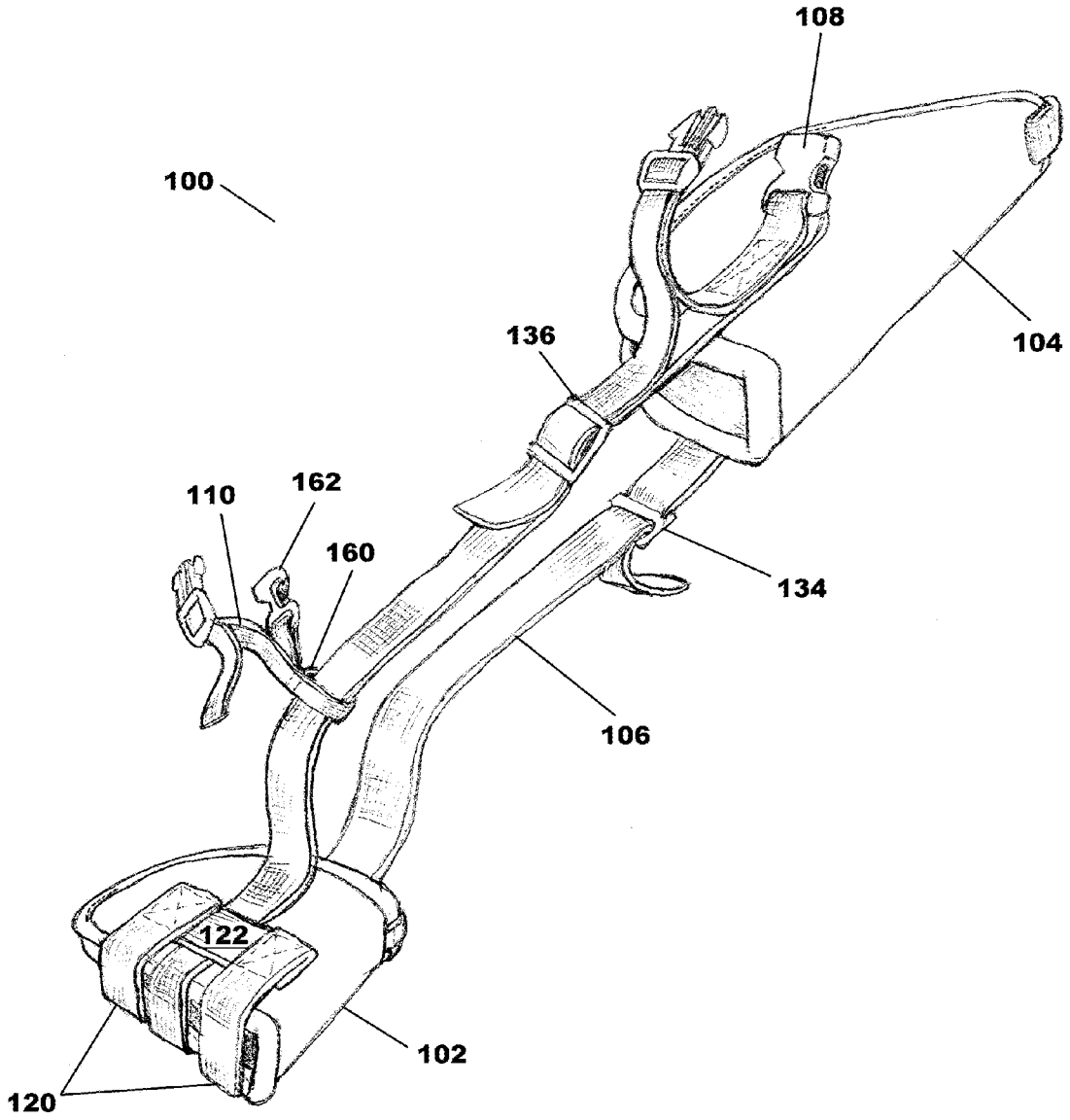
FIGS. 5A-5B are perspective views of an adjustable holster according to one embodiment of the present invention.
Figure 5B:
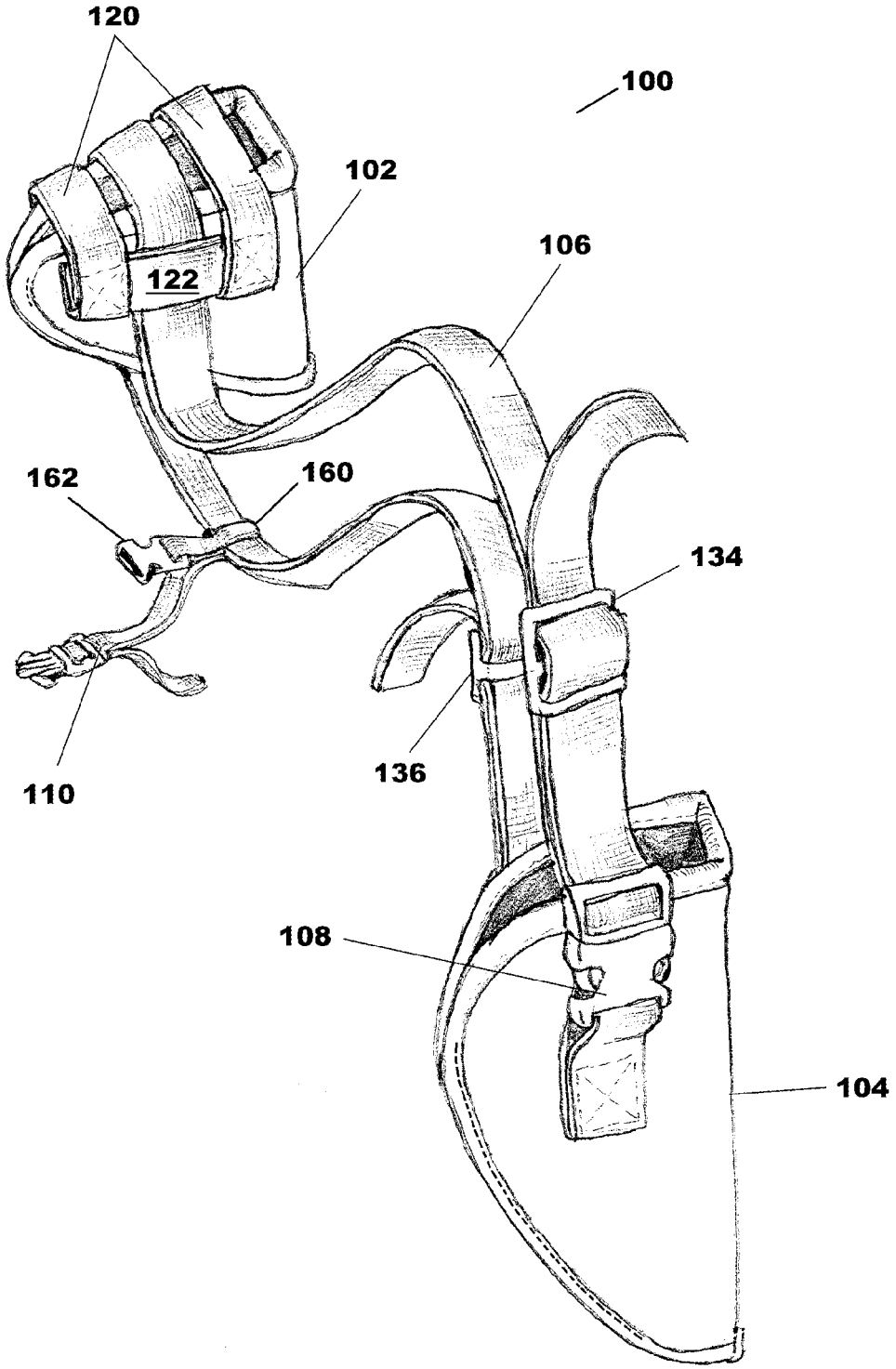

Referring to FIGS. 5A and 5B, detailed diagrams of the holster 100 are illustrated. As stated previously, the first member 102 can be slidably engaged to the connector strap 106 by the guide straps 122. As shown in FIGS. 4 and 5A-5B, the connector strap 106 can be threaded through the guide straps 122 on each side of the first member 102. As shown, the first member 102 can slide along a length of the connector strap 106. Generally, as the connector strap 106 is shortened, the first member 102 and the second member 104 can be brought closer together. Alternatively, when the connector strap 106 is lengthened, the first member 102 and the second member 104 can be spaced further apart. It is to be appreciated that since the first member 102 is slidably engaged to the connector strap 106, a length of the connector strap 106 on each side of the members 102, 104 can be kept approximately the same length. As implemented, the gun holster 100 can be used with guns having a variety of lengths.

In one embodiment, the connector strap 106 can include a strap adjuster 134. The strap adjuster 134 can be implemented to tighten the gun holster 100 to a gun. For instance, the connector strap 106 can be shortened by the strap adjuster 134 to tighten the gun holster 100 to a short barrel rifle. In another instance, the connector strap 106 can be lengthened by the strap adjuster 134 to fit a long barrel rifle. Generally, after the buttstock and the forestock/barrel are engaged with the members 102, 104, the connector strap 106 can be shortened to secure the gun 112 to the gun holster 100. The strap adjuster 134 can include, but is not limited to, a tri-bar slide, a buckle, a hook and loop patch, buttons, snap fasteners, etc.

As shown generally in the FIGS. 1 and 6, the first attachment structure 108 and the second attachment structure 110 can be implemented to secure the gun holster 100 to a pack 170. Generally, the first attachment structure 108 and the second attachment structure 110 can be removably coupled to a shoulder strap 172 of the pack 170. In one embodiment, the first attachment structure 108 can be attached to an upper portion of the shoulder strap 172 and the second attachment structure 110 can be attached to a lower portion of the shoulder strap 172. It is to be appreciated that the gun holster 100 can be attached to the pack 170 in a variety of combinations. For instance, where a pack has two shoulder straps, the first attachment structure 108 and the second attachment structure 110 can be coupled to different shoulder straps.

As shown in FIGS. 5A-5B, the first attachment structure 108 can include a strap of material coupled to the second member 104. Typically, one end of the first attachment structure 108 can be coupled to the second member 104 proximate the connector strap 106. Another end of the first attachment structure 108 can interface with the connector strap 106 via a strap adjuster 136. The strap adjuster 136 can be implemented to loosen and tighten a loop formed by the first attachment structure 108. In one embodiment, the first attachment structure 108 can detachably couple to itself. For instance, the end of the first attachment structure 108 attached to the second member 104 can include one part of a quick connect buckle. As shown, a midsection of the first attachment structure 108 can include the other part of the quick connect buckle. Generally, a size of the loop formed by the first attachment structure 108 can be adjusted.

The second attachment structure 110 can include a strap of material formed into two loops. As shown in FIGS. 4 and 5A-5B, a first loop 160 can be slidably secured to the connector strap 106. As implemented, the second attachment structure 110 can slide along a length of the connector strap 106. The second attachment structure 110 can be implemented to attach to a variety of differently sized packs. A second loop 162 can be included to detachably couple to the strap 172 of the pack 170. Generally, the second loop 162 of the second attachment structure 110 can include a detachable coupler. For instance, the second loop 162 can include a quick connect buckle. It is to be appreciated that other types of detachable couplers can be implemented without exceeding a scope of the present invention.

A Method of Using a Long Gun Holster

In one example method of using the gun holster 100, the holster 100 can be secured to a pack. In a typical implementation, a gun can first be secured to the holster 100. To secure the gun to the holster 100, the buttstock of the gun can be inserted into the first member 102 and the barrel/forestock can be inserted into the second member 104. In some instances, the connector strap 106 can be uncoupled from the second member 104 to allow easier securement of the gun. After the gun has been inserted into the members 102, 104, the connector strap 106 can be reconnected to the second member 104. If there is slack in the connector strap 106, the connector strap 106 can be tightened to ensure the gun is safely secured between the members 102, 104.

After the gun has been secured, the holster 100 can be attached to a pack. Depending on the type of pack and number of shoulder straps, a user can determine which side of the pack to secure the holster 100 to. For instance, the user may choose either a left side or a right side of a standard backpack. Once the user has determined which side, the user can proceed to couple the attachment structures to a shoulder strap. In a typical implementation, the first attachment structure 108 can be attached to an upper portion of the shoulder strap and the second attachment structure 110 can be attached to a lower portion of the shoulder strap.

It is to be appreciated that the holster can be attached to a plurality of types of packs and the described method is for illustrative purposes and is not meant to be limiting.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A holster comprising:

a first member for receiving a buttstock of a gun;

a second member for receiving a forestock and a barrel of a gun, the second member being defined by a U-shaped panel that engages the forestock of the gun;

a strap coupling the first member to the second member, wherein the first member slidably interfaces with the strap and freely moves along the strap;

a first attachment structure coupled to the second member, the first attachment structure adapted to couple to a backpack shoulder strap; and a second attachment structure slidably coupled to the strap, wherein the second attachment structure (i) is adapted to couple to the backpack shoulder strap, and (ii) slides along the strap without adjusting a length of the strap;

wherein (i) a first end of the strap is removably coupled to a first side of the second member and (ii) a second end of the strap is coupled to a second side of the second member.

2. The holster of claim 1, wherein the strap adjustably couples the first member to the second member.

3. The holster of claim 2, wherein the holster further includes a strap adjuster to alter a length of the strap between the first member and the second member.

4. The holster of claim 1, wherein (i) the first attachment structure includes a quick release buckle and (ii) the second attachment structure includes a quick release buckle.

5. The holster of claim 1, wherein the first member includes a pair of guide straps.

6. The holster of claim 5, wherein the strap is threaded through each of the guide straps.

7. The holster of claim 6, wherein the first member further includes a pair of support straps adapted to interface with the buttstock of the gun.

8. A method of using the holster of claim 1 comprising:
inserting the buttstock of the gun in the first member;
inserting the forestock/barrel of the gun in the second member;
securing the first attachment structure to an upper portion of a shoulder strap of a pack; and
securing the second attachment structure to a lower portion of the shoulder strap of the pack.

9. The method of claim 8, further comprising:
uncoupling the strap from the second member before inserting the gun in the first member and the second member;
coupling the strap to the second member after inserting the gun in the first member and the second member; and
tightening the strap.

10. The method of claim 8, wherein the gun is selected from the group consisting of a shotgun, a rifle, a musket, and a carbine.

11. The method of claim 8, wherein (i) the first attachment structure includes a quick release buckle and (ii) the second attachment structure includes a quick release buckle.

12. The method of claim 8, wherein the first member includes a pair of guide straps.

13. The method of claim 12, wherein the strap is threaded through each of the guide straps.

14. A combination comprising:
the holster of claim 1; and
a gun.

15. The combination of claim 14, wherein the gun is selected from a group consisting of a shotgun, a rifle, a musket, and a carbine.

16. A holster apparatus comprising:
a gun;
a pack having at least one shoulder strap; and
a holster including:
a first member for receiving a buttstock of the gun, the first member including a pair of guide straps and a pair of support straps;
a second member for receiving a forestock/barrel of the gun;
a strap adjustably coupling the first member to the second member, wherein the strap slidably interfaces with the guide straps of the first member;
a first attachment structure including a quick release buckle coupled to the second member; and
a second attachment structure including a quick release buckle slidably coupled to the strap;
wherein the first attachment structure removably couples to an upper portion of the shoulder strap and the second attachment structure removably couples to a lower portion of the shoulder strap.

17. The holster apparatus of claim 16, wherein the gun is selected from a group consisting of a shotgun, a rifle, a musket, and a carbine.

18. A combination comprising:
a pack having at least one shoulder strap; and
a holster including:
a first member for receiving a buttstock of a gun;
a second member for receiving a forestock and a barrel of a gun;
a strap coupling the first member to the second member, wherein the first member slidably interfaces with the strap and moves freely along a length of the strap;
a first attachment structure coupled to the second member, the first attachment structure removably coupled to an upper portion of the shoulder strap; and
a second attachment structure slidably coupled to the strap and removably coupled to a lower portion of the shoulder strap.

19. A holster comprising:
a first member for receiving a buttstock of a gun;
a second member for receiving a forestock and a barrel of a gun, the second member being defined by a U-shaped panel that engages the forestock of the gun;
a strap coupling the first member to the second member, wherein the first member slidably interfaces with the strap and freely moves along the strap;
a first attachment structure coupled to the second member, the first attachment structure adapted to couple to a backpack shoulder strap; and
a second attachment structure slidably coupled to the strap, wherein the second attachment structure (i) is adapted to couple to the backpack shoulder strap, and (ii) slides along the strap without adjusting a length of the strap;
wherein (i) the first attachment structure includes a quick release buckle and (ii) the second attachment structure includes a quick release buckle.

20. A holster comprising:
a first member for receiving a buttstock of a gun, the first member including a pair of guide straps;
a second member for receiving a forestock and a barrel of a gun, the second member being defined by a U-shaped panel that engages the forestock of the gun;
a strap coupling the first member to the second member, wherein (i) the strap is threaded through each of the guide straps and (ii) the first member slidably interfaces with the strap and freely moves along the strap;
a first attachment structure coupled to the second member, the first attachment structure adapted to couple to a backpack shoulder strap; and
a second attachment structure slidably coupled to the strap, wherein the second attachment structure (i) is adapted to couple to the backpack shoulder strap, and (ii) slides along the strap without adjusting a length of the strap.

* * * * *